United States Patent [19]

Nakamura et al.

[11] 4,323,644

[45] Apr. 6, 1982

[54] PHOTOGRAPHIC MATERIAL CONTAINING POLYMERS WITH ACTIVE ESTER GROUPS

[75] Inventors: Taku Nakamura; Masasi Ogawa; Kunio Ishigaki, all of Minami-ashigara, Japan

[73] Assignee: Fuji Photo Film Co., Ltd., Kanagawa, Japan

[21] Appl. No.: 204,669

[22] Filed: Nov. 5, 1980

[30] Foreign Application Priority Data

Nov. 5, 1979 [JP] Japan ..... 54/143036

[51] Int. Cl.[3] ..... G03C 1/78

[52] U.S. Cl. ..... 430/518; 430/527; 430/528; 430/529; 430/536; 430/621; 430/623; 430/627; 430/629; 430/630

[58] Field of Search ..... 430/527, 528, 529, 312, 430/621, 623, 627, 629, 630, 518, 536

[56] References Cited

U.S. PATENT DOCUMENTS

| | | | |
|---|---|---|---|
| T955,003 | 2/1977 | Mann et al. | 430/527 |
| 3,411,912 | 11/1968 | Dykstra et al. | 430/627 |
| 3,518,088 | 6/1970 | Dunn et al. | 430/627 |
| 3,706,564 | 12/1972 | Hollister et al. | 430/629 |
| 3,852,073 | 12/1974 | Fitzgerald | 430/627 |
| 3,868,252 | 2/1975 | Campbell et al. | 430/627 |

OTHER PUBLICATIONS

Mann et al. Defensive Publications T955003, Feb. 1, 1977 class 430, subclass 527.

*Primary Examiner*—Jack P. Brammer

*Attorney, Agent, or Firm*—Sughrue, Mion, Zinn, Macpeak and Seas

[57] ABSTRACT

A photographic material having at least one layer containing a polymer having a repeating unit of the formula (I):

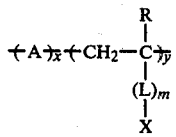

(I)

wherein A is a monomer unit copolymerized with a copolymerizable ethylenically unsaturated monomer; R is a hydrogen atom or a lower alkyl group having 1 to about 6 carbon atoms; L is a bivalent linking group having 1 to about 20 carbon atoms; X is an active ester group; x and y each represents molar percent, x being between 0 and 95 and y being between 5 and 100; m is 0 or 1.

16 Claims, No Drawings

PHOTOGRAPHIC MATERIAL CONTAINING POLYMERS WITH ACTIVE ESTER GROUPS

BACKGROUND OF THE INVENTION

1. Field of the Invention

This invention relates to a photographic material, more particularly, to a photographic material containing a reactive polymer having a pendant (wherein the word "pendant" means that a reactive group is present at a side chain of a polymer) active ester group.

2. Development of the Invention

It is known to incorporate various polymers in a photographic system as mordants, antistatic agents, neutralizing agents, thickeners and sensitizers. However, these polymers, particularly when they are water-soluble, diffuse from a coated layer to an adjacent layer(s) and can adversely affect the properties of a photographic film (e.g., increase fogging, lower sensitivity and cause dye image spreading). To prevent this, mordants are rendered non-diffusable by incorporating therein a functional group reactive with gelatin (as described in U.S. Pat. No. 3,625,694) or by incorporating therein a functional group that reacts with a crosslinking agent (as described in U.S. Pat. No. 3,859,096).

However, the reactivity of functional groups incorporated in mordants of this type is low and it has been difficult to provide non-diffusable mordants reaction with gelatin or a crosslinking agent before diffusion occurs.

Therefore, the development of polymers having incorporated therein a highly reactive functional group that quickly reacts with gelatin or a crosslinking agent to render the polymer non-diffusable has been long needed.

One technique is known to bind various photographic additives to certain polymers to thereby fix them in a layer where they are added or make them nondiffusable.

The term "photographic additives" as used herein means additives as are conventionally used in photographic systems such as dyes, dye precursors, development restrainers, development accelerators, couplers, developing agents, auxiliary developer agents, bleaching restrainers, bleaching accelerators, silver halide solvents, silver complexing agents, foggants, anti-foggants, chemical sensitizers, spectral sensitizers, desensitizers, hardening agents, hardening accelerators, gelatin and surfactants.

Reactive polymers have been used in diffusion transfer to fix a diffusing dye within a photographic element, e.g., mordants as described in U.S. Pat. Nos. 3,709,690, 3,898,088 and 3,958,995, will fix a dye in diffusion transfer, but these mordants are cationic and fix anionic dyes by mutual electrostatic interaction and their fixing ability is not always satisfactory in that it is reduced by water in the photographic system or decreased pH so that the fixed dye easily fades upon exposure to sunlight or fluorescent light.

To eliminate these defects, a mordant that will fix certain dyes via covalent bonds is described in Japanese Patent Application (OPI) No. 65033/79 (ther term "OPI" as used herein refers to a "published unexamined Japanese patent application"). While this mordant is a good mordant for the specific types of dyes described in Japanese Patent Application (OPI) Nos. 111628/74 and 4819/77, it is not applicable to other dyes. In addition, the mordant does not fix the dyes at a high enough speed and is difficult to synthesize.

Therefore, the development of a mordant which rapidly and positively fixes diffused dyes does not permit the fixed dye to fade upon exposure to light and which is easy to synthesize on a large scale has been desired in the art.

Further, most photographic materials contain gelatin as a component, e.g., a silver halide photosensitive emulsion layer, an emulsion protective lyaer, a filter layer, an intermediate layer, an antihalation layer, a backing layer, a subbing layer on film base and a baryta layer use gelatin as a primary component. These gelatin-containing light-sensitive materials are processed with various aqueous solutions at different pHs and/or temperatures, but a gelatin-containing layer untreated with a hardener has low resistance to water and is easily scratched after swelling in an aqueous solution, and, in an extreme case, a gelatin layer may even dissolve out in a processing solution having a temperature of 30° C. or more.

A number of compounds are known to be effective for hardening gelatin and increasing the water resistance, heat resistance and scratch resistance of a gelatin layer and are known as hardening agents in the production of photographic materials. For example, inorganic compounds such as chrome alum and organic compounds such as aldehyde compounds such as formaldehyde and glutaraldehyde, compounds having an active halogen as described in U.S. Pat. No. 3,288,775, etc., compounds having a reactive ethylenically unsaturated group as described in U.S. Pat. No. 3,635,718, etc., aziridine compounds as described in U.S. Pat. No. 3,017,280, etc., epoxy compounds as described in U.S. Pat. No. 3,091,537, etc., and halogenocarboxyaldehyde such as mucochloric acid are known. However, these hardening agents have one or more of the following defects: they have an adverse effect on the properties of a photosensitive material (e.g., increase fogging, lower sensitivity or change gradation), cause "after-hardening" wherein the hardening effect changes upon extended storage, are not adequately dissolved in water and cause lack of uniformity of the additives dispersed in the photographic layer, lose their hardening effect depending upon the photographic accitive used therewith (e.g., a color coupler for color photosensitive materials), are unstable and do not keep long, or are difficult to synthesize in large quantities.

A hardener of low molecular weight as is frequently used in hardening gelatin also will diffuse in a gelatin layer so that it is impossible to control the degree of hardening of laminated gelatin layers on a film base. On the other hand, commonly used polymeric non-diffusable gelatin hardening agents such as dialdehyde starch and polyacrolein are not satisfactory for use in a photosensitive material because they have adverse effects on photographic characteristics, such as to increase fogging and lower sensitivity. The polymeric hardening agents described in U.S. Pat. No. 4,161,407—which have a vinyl sulfone group as an active group—cause after-hardening because they harden a gelatin layer only slowly and the degree of swelling Q (defined hereunder) canges with time. Therefore, the development of a hardening agent that rapidly hardens a gelatin layer and which does not have any adverse effect on photographic characteristics has long been desired in the art.

SUMMARY OF THE INVENTION

Therefore, one object of this invention is to provide a photographic material containing a photographic polymer which has been rendered non-diffusable by incorporating therein a highly reactive functional group.

Another object of this invention is to provide a photographic material wherein a photographic additive having a nucleophilic group (for example, an amino group, a hydroxyl group, a phenolic hydroxyl group, a sulfonamide group, and a reactive methylene group) is securely fixed to a desired photographic layer or rendered non-diffusable in that layer.

A further object of this invention is to provide a dye mordant advantageously used in a photographic material to be processed by diffusion transfer.

A still further object of this invention is to provide a non-diffusable gelatin hardening agent that hardens gelatin quickly and has high solubility.

Another object of this invention is to provide a method for making a photographically useful non-diffusable polymer.

Still another object of this invention is to provide a method for fixing a photographic additive having a nucleophilic group or rendering the additive non-diffusable.

These objects of this invention are achieved by a photographic material having at least one layer containing a polymer having a repeating unit of the formula (I):

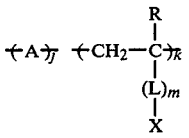

(I)

wherein A is a monomer unit copolymerized with a copolymerizable ethylenically unsaturated monomer; R is a hydrogen atom or a lower alkyl group having 1 to about 6 carbon atoms; L is a bivalent linking group having 1 to about 20 carbon atoms; X is an active ester group; j and k each represents molar percent, with j being between 0 and 95 and k being between 5 and 100; m is 0 or 1.

DETAILED DESCRIPTION OF THE INVENTION

Examples of ethylenically unsaturated monomers used to prepare polymers preferred in this invention include ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids (e.g., vinyl acetate and allyl acetate), ethylenically unsaturated mono- or dicarboxylic acids and salts thereof (e.g., acrylic acid, methacrylic acid, itaconic acid, maleic acid and $CH_2{=}CHCOONa$), maleic anhydride, esters of ethylenically unsaturated monocarboxylic or dicarboxylic acids (e.g., n-butyl acrylate, n-hexyl acrylate, hydroxyethyl acrylate, cyanoethyl acrylate, N,N-diethylaminoethyl acrylate, methyl methacrylate, n-butyl methacrylate, benzyl methacrylate, hydroxyethyl methacrylate, chloroethyl methacrylate, methoxyethyl methacrylate, N,N-diethylaminoethyl methacrylate, N,N,N-triethyl-N-methacryloyloxyethylammonium-p-toluene sulfonate, N,N-diethyl-N-methyl-N-methacryloyloxyethylammonium-p-toluene sulfonate, dimethyl itaconate and monobenzyl maleate), and amides of ethylenically unsaturated monocarboxylic or dicarboxylic acids (e.g., acrylamide, N,N-dimethylacrylamide, N-methylolacrylamide, N-(N,N-dimethylaminopropyl)acrylamide, N,N,N-trimethyl-N-(N-acryloylpropyl)ammonium-p-toluene sulfonate, sodium 2-acrylamide-2-methylpropane sulfonate, acryloyl morpholine, and methacrylamide).

Monomer unit "A" is selected dependant upon the use of the polymer of this invention (i.e., whether it is used as a mordant, an antistatic agent or a hardening agent in diffusion transfer) and its properties (e.g., solubility, glass transition point or whether it is cationic, anionic or nonionic). To provide a polymer having more than one function, "A" may comprise two or more monomer units. (1) If the polymer is used as an antistatic agent, "A" is preferably a cationic monomer (for example, N,N,N-trimethyl-N-vinylbenzylammonium chloride, etc.) or an anionic monomer (for example, sodium acrylate, sodium 2-acrylamide-2-methylpropane sulfonate, etc.); (2) if the polymer is used as a mordant, "A" is preferably a cationic monomer (for example, N,N-diethyl-N-methyl-N-methacryloyloxyethylammonium-p-toluene sulfonate, etc.); and (3) if the polymer is used as a hardening agent, "A" is not restricted but to render the polymer water-soluble. To provide a polymer having increased water solubility, "A" is preferably an ionic monomer or acrylamide. If the polymer of this invention is used as a cross-linked latex, "A" includes not only the monoethylenically unsaturated monomers defined above but also monomers having at least two copolymerizable ethylenically unsaturated groups (e.g., divinylbenzene, methylenebisacrylamide, ethylene glycol diacrylate, trimethylene glycol diacrylate, ethylene glycol dimethacrylate, trimethylene glycol dimethacrylate and neopentyl glycol dimethacrylate). When the monoethylenically unsaturated monomer and the monomer having at least two copolymerizable ethylenically unsaturated groups are used as "A", the monomer having at least two copolymerizable ethylenically unsaturated groups is used in an amount of 10 mol% or less based on the total mols of the monomers used (i.e., "A" plus

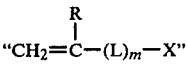

plus "the monomer having at least two copolymerizable ethylenically unsaturated groups").

"R" represents a hydrogen atom or a lower alkyl group having 1 to about 6 carbon atoms (e.g., methyl, ethyl, butyl or n-hexyl); a hydrogen atom and a methyl group are particularly preferred.

"L" is a divalent linking group having 1 to about 20 carbon atoms; those represented by the following formulae (II) to (VI) are preferred:

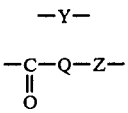

(II)

(III)

-continued

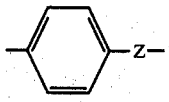

(IV)

wherein Y is an alkylene group having 1 to 10 carbon atoms (e.g., methylene, ethylene or propylene group) or an arylene group having 6 to 12 carbon atoms; Q is —O—, —NH— or

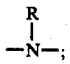

Z is a group represented by Y or a bivalent group having at least one amido, ester, ether or thioether bond and having Y at both ends (e.g., $—CH_2CH_2—$, $—CH_2CH_2CH_2CH_2CH_2—$, $—CH_2CONHCH_2—$, $—CH_2CONHCH_2CONHCH_2—$, $—CH_2CH_2OCOCH_2CH_2—$ or $—CH_2NHCOCH_2CH_2SCH_2—$); R is the same as defined above. Examples of "L" include the following:

$—CONHCH_2—$, $—CONHCH_2CH_2—$, $—CONHCH_2CH_2CH_2—$, $—CONHCH_2CH_2CH_2CH_2CH_2—$, $—CO_2CH_2CH_2OCOCH_2CH_2—$, $—CONHCH_2CONHCH_2—$, $—CONHCH_2CONHCH_2CONHCH_2—$, $—CO_2CH_2—$, $—CONHCH_2NHCOCH_2CH_2SCH_2CH_2—$, $—CONHCH_2OCOCH_2CH_2—$, etc.

This invention includes the situation where m=0 or L is absent. "X" represents an active ester group i.e., a carboxylic acid ester of an alcohol (pKa=5-13) and includes, e.g., the following groups:

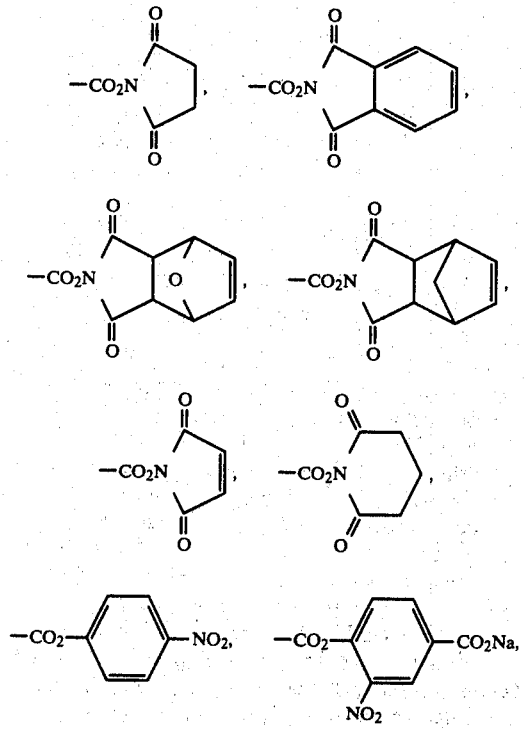

-continued

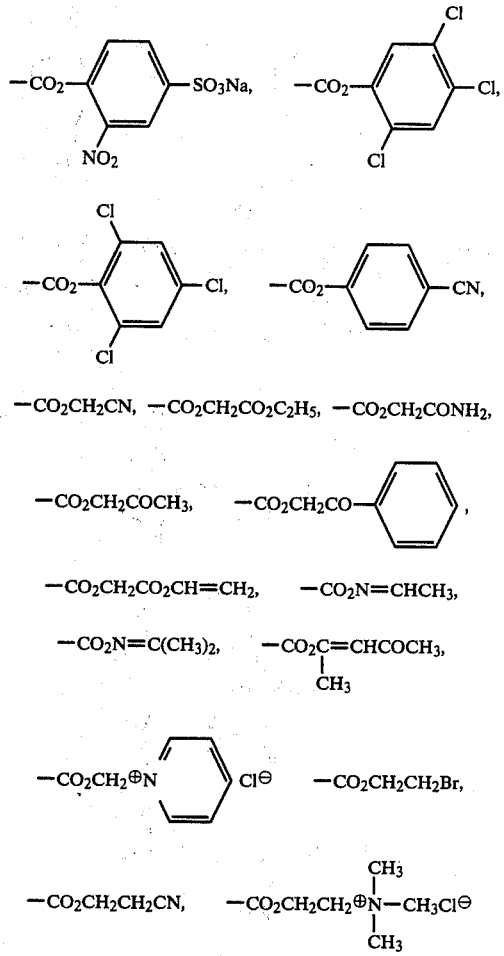

"X" can be freely selected depending upon the type of R, the type and properties (e.g., hydrophilic, hydrophobic or rigid) of L, the type and properties (e.g., cationic, nonionic, anionic, hydrophilic or hydrophobic) of A and the use of the polymer of this invention.

The polymer having a repeating unit of the formula (I) according to this invention has a number average molecular weight of about 5,000 to about 100,000. However, when the monomer "A" is a crosslinked monomer (such as divinylbenzene, etc.), the upper limit of the number average molecular weight of the polymer is not restricted to the above (i.e., about 100,000).

The polymer of this invention having a repeating unit of formula (I) is generally prepared by polymerizing ethylenically unsaturated monomer (A) defined above with an unsaturated monomer of formula (V) below:

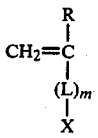

(V)

wherein R, L, X and m are the same as defined above.

Preferred examples of the unsaturated monomer of formula (V) are given below:

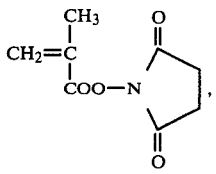

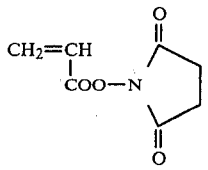

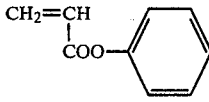

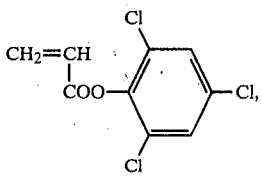

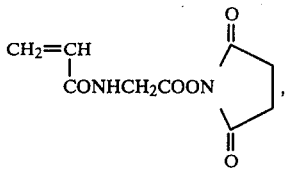

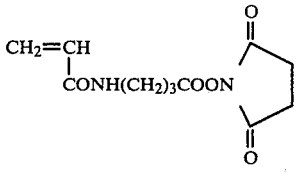

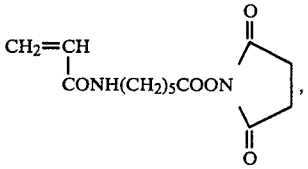

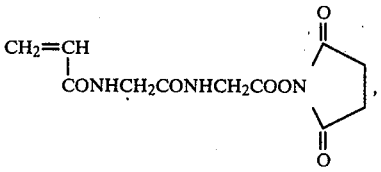

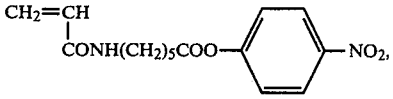

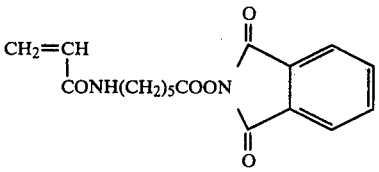

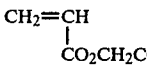

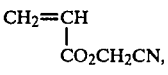

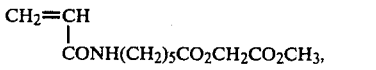

-continued

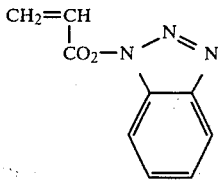

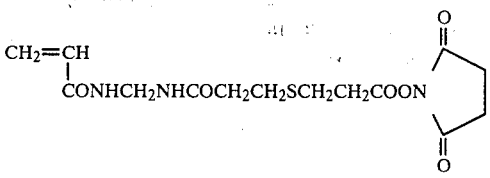

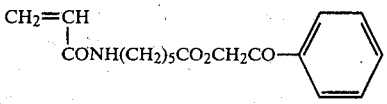

The unsaturated monomers of formula (V) having an active ester group can be synthesized and polymerized by various known methods, such as the method of Ronald L. Schnaar and Yuan Chuan Lee described in *Biochemistry,* p. 1535 (1975), the method of Anthony Winston and Glenn R. McLaughlin described in *Journal of Polymer Science,* Polymer Chemistry Edition, p. 2155 (1976), the method of Hans-Georg Batz and Johanna Koldehotf described in *Die Makromolekule Chemie,* Vol. 177, p. 683 (1976), the method of Hans,-Georg Batz, Giselner Franzmann and Helmut Ringsdorf described in *Angewante Chemie,* Internat. Edit., p. 1103 (1972), and the method of P. Ferruti, A. Bettelli and Angelino Fere described in *Polymer,* p. 462 (1972).

The synthesis of typical unsaturated monomers having an active ester group is illustrated below by specific examples.

SYNTHESIS EXAMPLE 1

Synthesis of N-acryloyloxysuccinimide (M-1)

To a mixture of 400 ml of chloroform, 115 g of N-hydroxysuccinimide and 72 g of acrylic acid in a reaction vessel, 206 g of N,N-dicyclohexylcarbodiimide dissolved in 100 ml of chloroform was added dropwise over a period of 2 hours under cooling with ice water. Following a 2-hour stirring at room temperature, the precipitate was filtered off and the filtrate concentrated at low temperature for crystallization. The resulting crystals were filled to give 116 g of N-acryloyloxysuccinimide (mp=61°-62° C., yield=68%). The active ester content was determined by the method of Ronald L. Schnaar and Yuan Chuan Lee described in *Biochemistry,* p. 1535 (1975) as $5.2\times10^{-3}$ eq./g.

Other unsaturated monomers having an active ester group can be easily prepared by any method employed in conventional ester synthesis, e.g., the dehydrating condensation of a corresponding carboxylic acid monomer and an alcohol in the presence of DCC (N,N-dicyclohexylcarbodiimide); reaction between a corresponding carboxylic acid halide monomer and an alcohol; or reaction between a corresponding carboxylate salt monomer and an active halide. Table 1 lists the characteristics of monomers M-1 to M-7 -synthesized per the above procedure.

TABLE 1

Synthesis of Active Ester Monomers

| | Synthesis Scheme | Active Ester Monomer | Yield (%) | m.p. (°C.) | Active Ester Content (eq./g) |
|---|---|---|---|---|---|
| M-1 | 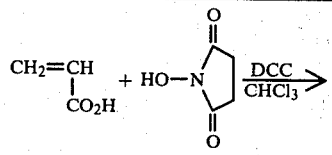 | 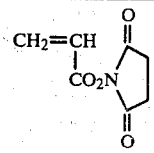 | 68 | 61 ~ 62 | $5.2 \times 10^{-3}$ |
| M-2 | 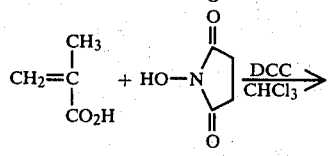 | 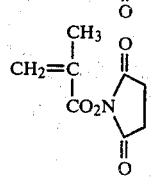 | 89 | 99 ~ 100 | $3.8 \times 10^{-3}$ |
| M-3 | 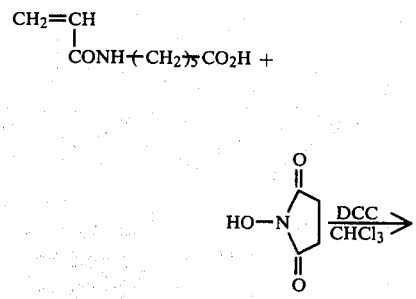 | 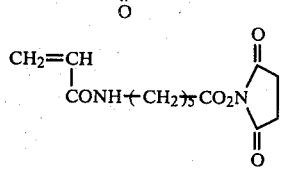 | 96 | 80 ~ 83 | $2.8 \times 10^{-3}$ |
| M-4 | 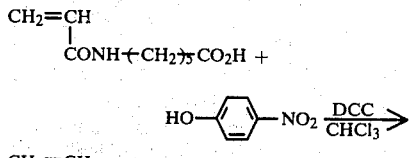 | 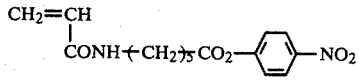 | 67 | 85 ~ 87 | |
| M-5 | 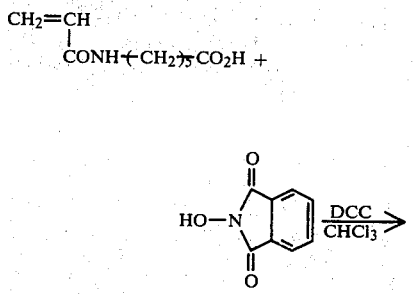 | 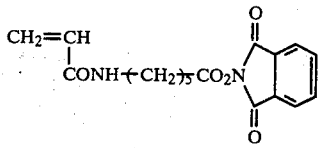 | 49 | 108 ~ 112 | $2.7 \times 10^{-3}$ |
| M-6 |  |  | 60 | b.p. 60 ~ 62 11.8 mmHg | |
| M-7 | 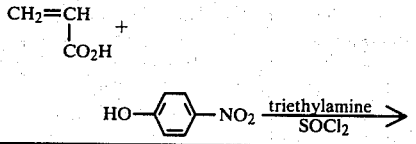 | 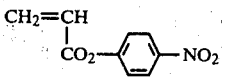 | 10 | 60 ~ 61 | $1.5 \times 10^{-3}$ |

The polymer of this invention can be produced by homopolymerizing an unsaturated monomer of formula (V) or copolymerizing one or more of such monomers with one or more ethylenically unsaturated monomers as listed before. For specific polymerization procedures, see the references listed above.

The synthesis typical polymers of this invention is illustrated below by specific examples.

SYNTHESIS EXAMPLE 2

Synthesis of poly(acrylamide-co-ε-acryloylaminocaproic succinimide ester) (P-10)

A mixture of 5.3 g of acrylamide, 7.1 g of ε-acryloylaminocaproic succinimide ester (M-3) and 70 g of DMF (dimethylformamide) in a reaction vessel was heated at 60° C. under stirring while 0.25 g of 2,2'-azo-bis-2,4-dimethylvaleronitrile (available form Wako Pure Chemical Industries, Ltd. under the trade name "V-65") was added to the mixture. Following a 7 hour stirring at 60° C., the mixture was allowed to cool to room temperature. The mixture was then added to 500 ml of acetone, and the resulting precipitate filtered off and dried to give 10 g of a white polymer product (yield=81%). The active ester content in the polymer was $1.2\times10^{-3}$ eq./g.

Table 2 lists the characteristics of polymers P-1 to P-13 synthesized per the above procedure.

TABLE 2

Synthesis of Active Ester Monomers

| | Ethylenically Unsaturated Monomer | Active Ester Monomer | j:k Molar Ratio | Type of Polymerization | Initiator | Solvent | Yield (%) | Active Ester Content (eq./g) |
|---|---|---|---|---|---|---|---|---|
| P-1 | $CH_2{=}CH$ \| $CONH_2$ | M1 | 95:5 | precipitation polymerization | V-65 | THF* | 97 | $4.0\times10^{-4}$ |
| P-2 | " | " | 90:10 | precipitation polymerization | " | " | 98 | $7.8\times10^{-4}$ |
| P-3 | " | " | 80:20 | precipitation polymerization | " | " | 96 | $1.4\times10^{-3}$ |
| P-4 | " | " | 65:35 | precipitation polymerization | " | " | 90 | $1.9\times10^{-3}$ |
| P-5 | " | " | 50:50 | precipitation polymerization | " | " | 86 | $2.5\times10^{-3}$ |
| P-6 | $CH_2{=}CH$ \| $CONH(CH_2)_3\overset{\oplus}{N}(CH_3)_3p\text{-}TsO^{\ominus}$ | " | 25:75 | solution polymerization | " | DMF | 68 | $1.7\times10^{-3}$ |
| P-7 | " | " | 50:50 | solution polymerization | " | " | 98 | $2.0\times10^{-3}$ |
| P-8 | " | " | 75:25 | solution polymerization | " | " | 100 | $8.4\times10^{-4}$ |
| P-9 | " | " | 50:50 | precipitation polymerization | " | acetone | 61 | $2.0\times10^{-3}$ |
| P-10 | $CH_2{=}CH$ \| $CONH_2$ | M3 | 75:25 | solution polymerization | " | DMF | 81 | $1.2\times10^{-3}$ |
| P-11 | $CH_2{=}CH$ \| $CONH(CH_2)_3\overset{\oplus}{N}(CH_3)_3p\text{-}TsO^{\ominus}$ | " | 60:40 | solution polymerization | " | " | 98 | $4.4\times10^{-4}$ |
| P-12 | " | M5 | 50:50 | solution polymerization | " | " | 69 | $7.9\times10^{-4}$ |
| P-13 | " | M6 | 50:50 | precipitation polymerization | " | acetone | 70 | |

*tetrahydrofuran

As noted before, the presence of a highly reactive ester group in the polymer of this invention enables the polymer to be used in a photographic system as various additives listed below:

(i) polymeric mordant, antistatic agent, neutralizing agent, thickener or sensitizer required to be non-diffusable;

(ii) polymer for fixing or rendering non-diffusable a photographic additive having a nucleophilic group such as an amino, hydroxyl, phenolic hydroxyl, active methylene or sulfonamide group; and (iii) gelatin hardening agent.

The polymer of this invention is used in an amount and in a location in a photographic element as is conventional for the purposes described above.

The utility of the polymer of this invention is hereunder described assuming that it is used as a gelatin hardening agent. When the polymer of this invention is used as a hardening agent, the amount used can be freely selected depending upon the objective. Usually, the polymer is used in an amount such that it contains from $0.5\times10^{-3}$ to $5\times10^{-2}$ eq. of active ester group per 100 g of dry gelatin. A particularly preferred range is from $5\times10^{-3}$ to $5\times10^{-2}$ eq. per 100 g of dry gelatin.

The polymer of this invention may be used as a hardening agent independently or in combination with other low molecular or high molecular weight hardening agents. Examples of such low or high molecular weight hardening agents are compounds such as 2-hydroxy-4,6-dichloro-1,3,5-triazine which have a reactive halogen atom, compounds such as divinyl sulfone which have a reactive olefin bond, isocyanates, aziridines, epoxy compounds, mucochloric acid, chrome alum and aldehydes.

The reactive polymer of this invention that has an active ester group as a pendant group quickly hardens gelatin because of its high reactivity; hence it is free from "after-hardening". In addition, its solubility can be controlled by properly selecting the copolymerizable monomer. Since the polymer is non-diffusable, it controls the degree of hardening of individual laminated gelatin layers on a film base according to the level. As a further advantage, the polymer of this invention has no adverse effect on photographic characteristics.

There is no particular limitation on the silver halide, chemical sensitizer, silver halide solvent, spectral sensitizing dye, antifoggant, protective colloid such as gelatin, UV absorber, polymer latex bleaching agent, color coupler, anti-discoloration agent, dye, matting agent, surfactant and other additives incorporated in the silver halide emulsion layer or other layers of the photograhic material of this invention, and reference can be made to, for example, Research Disclosure, 176, pp. 22–31 (December, 1978) thereof. Reference can also be had to Research Disclosure ibid. for the support of the photographic material, methods of development, and layers that constitute a photographic material for diffusion transfer.

The photographic emulsion(s) used in this invention can be prepared by a conventional methods such as described in P. Glafkides, *Chimie et Physique Photogra-*

*phique,* Paul Montel, (1967), G. F. Duffin, *Photographic Emulsion Chemistry,* The Focal Press (1966), and V. L. Zelikman et al., *Making and Coating Photographic Emulsion,* The Focal Press (1964). Therefore, either the acid method, neutral method or ammoniacal method may be employed. A soluble silver salt may be reacted with a soluble halide salt by the single-jet or double-jet method or a combination thereof. The chemical sensitizer may be a sulfur compound or gold compound. The anti-foggant or stabilizer may be selected from among known anti-foggants or stabilizer: e.g., azoles such as a benzothiazolium salt, nitroindazole, nitrobenzimidazole, chlorobenzimidazole, bromobenzimidazole, mercaptothiazole, mercaptobenzothiazole, mercaptobenzimidazole, mercapto thiadiazole, aminotriazole, benzotriazole, nitrobenzotriazole and mercaptotetrazole (particularly, 1-phenyl-5-mercaptotetrazole); mercaptopyrimidines; mercaptotriazines; thioketo compounds such as oxazolinethion; azaindenes such as triazaindene, tetrazaindene (particularly, 4-hydroxy-substituted (1,3,3a,7) tetrazaindene), and pentazaindene; benzenethiosulfonic acid, benzenesulfinic acid and benzenesulfonic acid amide. Other examples of useful anti-foggants or stabilizers are described in U.S. Pat. Nos. 3,954,474, 3,982,947, and Japanese Patent Publication No. 28660/77.

Gelatin is used with advantage as a binder or protective colloid for any photographic emulsion, but other hydrophilic colloids may also be used. Examples of such hydrophilic colloids are proteins such as gelatin derivative, gelatin grafted with other polymers, albumin, and casein; cellulose derivatives such as hydroxyethyl cellulose, carboxymethyl cellulose, and cellulose sulfate ester, saccharide derivatives such as sodium alginate and starch derivative; and hydrophilic homopolymers or copolymers, e.g., polyvinyl alcohol, polyvinyl alcohol having acetal groups incorporated therein, poly-N-vinyl pyrrolidone, polyacrylic acid, polymethacrylic acid, polyacrylamide, polyvinyl imidazole and polyvinyl pyrazole.

The gelatin may be lime-processed gelatin, acid-processed gelatin or enzyme-processed gelatin of the type described in *Bull. Soc. Sci. Phot. Japan,* No. 16, p. 30 (1966). Hydrolyzed or enzyme-decomposed gelatin may also be used.

Examples of surfactants which may be used include nonionic surfactants such as saponin (steroid), alkylene oxide derivatives (e.g., polyethylene glycol, polyethylene glycol/polypropylene glycol condensate, polyethylene glycol alkyl or alkyl aryl ether, polyethylene glycol esters, polyethylene glycol sorbitan esters, polyalkylene glycol alkylamines or alkylamides, and polyethylene oxide adducts with silicone), glycidol derivatives (e.g., alkenylsuccinic polyglyceride and alkylphenol polyglyceride), aliphatic acid esters of polyhydric alcohols, alkyl esters of saccharides, and urethanes or ethers of saccharides; anionic surfactants containing an acidic group such as a carboxyl, sulfo, phospho, sulfate ester or phosphate group such as triterpenoid-saponin, alkylcarboxylate salts, alkylsulfonate salts, alkylbenzenesulfonate salts, alkylnaphthalenesulfonate salts, alkyl sulfate esters, alkyl phosphate esters, N-acyl-N-alkyl taurines, sulfosuccinate esters, sulfoalkyl polyoxyethylenealkylphenyl ethers, and polyoxyethylenealkyl phosphate esters; amphoteric surfactants such as amino acids, aminoalkylsulfonic acids, aminoalkylsulfuric or phosphoric acid esters, alkylbetaines, amineimides, and amineoxides; and cationic surfactants such as alkylamine salts, aliphatic or aromatic quaternary ammonium salts, heterocyclic quaternary ammonium salts such as pyridinium and imidazolium salts, and aliphatic or heterocyclic phosphonium or sulfonium salts.

Useful dyes for antihalation and antiirradiation include oxonol dyes, hemioxonol dyes, styryl dyes, merocyanine dyes, cyanine dyes and azo dyes. As oxonol dyes, hemioxonol dye and merocyanine dye are particularly advantageous. Specific examples of useful dyes are described in British Pat. Nos. 584,609, 1,177,429, Japanese Patent Application (OPI) Nos. 85130/73, 99620/74, 114420/74, 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352.

Useful spectral sensitizing dyes include cyanine dyes, merocyanine dyes, complex cyanine dyes, complex merocyanine dyes, holopolar cyanine dyes, hemicyanine dyes, styryl dyes and hemioxonol dyes. Particularly advantageous dyes are those referred to as cyanine dyes, merocyanine dyes and complex merocyanine dyes. Any nucleus that is usually used in cyanine dyes as a basic heterocyclic nucleus can be applied to these dyes. Illustrative nuclei include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus and a pyridine nucleus; nuclei wherein the above listed nuclei are fused to an alicyclic hydrocarbon ring; nuclei wherein these nuclei are fused to an aromatic hydrocarbon ring, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may be substituted on a carbon atom.

To a merocyanine dye or complex merocyanine dye, a nucleus having a ketomethylene structure such as a 5- to 6-membered heterocyclic nuclei (e.g., a pyrazoline-5-one nucleus, a thiohydantoin nucleus, a 2-thioxazolidine-2,4-dione nucleus, a thiazolidine-2,4-dione nucleus, a rhodanine nucleus, and a thiobarbituric acid nucleus) may be so used.

Known open-chain ketomethylene couplers may be used as yellow couplers. Benzoyl acetanilide and pivaloyl acetanilide compounds are used with advantage.

Pyrazolone compounds, indazolone compounds and cyanoacetyl compounds may be used as a magenta coupler; pyrazolone compounds are used with advantage.

Phenol or naphthol compounds may be used as a cyan coupler.

Examples of polymer latices for increasing dimensional stability include polymers wherein the monomer component is an alkyl (meth)acrylate, alkoxyalkyl (meth)acrylate, glycidyl (meth)acrylate, (meth)acrylamide, vinyl esters (e.g., vinyl acetate), acrylonitrile, olefins and styrene which can be used independently or as a mixture thereof, or which may be combined with acrylic acid, methacrylic acid, $\alpha,\beta$-unsaturated dicarboxylic acid, hydroxyalkyl (meth)acrylate, sulfoalkyl (meth)acrylate and styrene sulfonic acid. The polymer latices are used as aqueous system.

Useful anti-foggants include hydroquinone derivatives, aminophenol derivatives, gallic acid derivatives and ascorbic acid derivatives. Illustrative anti-foggants are described in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77 and Japanese Patent Publication No. 23813/75, etc.

Examples of the useful UV absorbants include aryl-substituted benzotriazole compounds (e.g., as described in U.S. Pat. No. 3,533,794), 4-thiazolidone compounds (e.g., as described in U.S. Pat. Nos. 3,314,794 and 3,352,681), benzophenone compounds (e.g., as described in Japanese Patent Application (OPI) No. 2784/71), cinnamate esters (e.g., as described in U.S. Pat. Nos. 3,705,805 and 3,707,375), butadiene compounds (e.g., as described in U.S. Pat. No. 4,045,229), and benzoxazole compounds (e.g., as described in U.S. Pat. No. 3,700,455). Other suitable examples thereof are described in U.S. Pat. No. 3,499,762 and Japanese Patent Application (OPI) No. 48535/79. UV absorbing couplers (e.g., α-naphthol cyan dye forming coupler) and UV absorbing polymers may also be used.

Useful anti-discoloration agents include hydroquinone derivatives as described in U.S. Pat. Nos. 2,360,290, 2,418,613, 2,675,314, 2,701,197, 2,704,713, 2,728,659, 2,732,300, 2,735,765, 2,710,801, 2,816,028 and British Patent 1,363,921; gallic acid derivatives as described in U.S. Pat. Nos. 3,457,079 and 3,069,262; p-alkoxyphenols as described in U.S. Pat. Nos. 2,735,765 and 3,698,909, Japanese Patent Publication Nos. 20977/74 and 6623/77; p-oxyphenol derivatives as described in U.S. Pat. Nos. 3,432,300, 3,573,050, 3,574,627 and 3,764,337, Japanese Patent Application (OPI) Nos. 35633/77, 147434/77 and 152225/77; and bisphenols as described in U.S. Pat. No. 3,700,455.

Advantageous supports are films composed of semi-synthetic or synthetic polymers such as cellulose nitrate, cellulose acetate, cellulose acetate butyrate, polystyrene, polyvinyl chloride, polyethylene terephthalate and polycarbonate, baryta paper, and paper coated or laminated with an α-olefin polymer(s) (e.g., polyethylene, polypropylene, and ethylene-butene copolymers). These supports may be colored with a dye or pigment and may even be blackened for light shielding. The surface of these supports is generally subbed to provide good contact with a photograhic emulsion layer or the like. Before subbing, the surface of the support may be treated by corona discharge, irradiated with ultraviolet rays, or subjected to flame treatment.

This invention is now described in greater detail by reference to the following examples which are given here for illustrative purposes only and are by no means intended to limit the scope of the invention.

EXAMPLE 1

Polymers P-4, P-6 and P-12 of this invention were added to a 7 wt% gelatin solution in the amounts given in Table 3 and applied uniformly to a subbed polyethylene terephthalate support in a dry thickness of about 7μ. After drying, the samples formed were stored for 1 day, 7 days, and 14 days at 25° C. and 50% RH. Part of each sample was immersed in water at 25° C. and the degree of swelling Q represented by the following formula was measured:

$$Q = \frac{\text{thickness of swollen film}}{\text{thickness of dry film}}$$

Separately from the measurement of Q, each sample was immersed in water and a needle having a round steel tip (0.4 mm radius) pressed against the surface of the sample was moved in parallel to that surface at a rate of 2.5 mm per second, with the load on the needle being changed continuously in the range of from 0 to 200 g. The load that caused a scratch on the surface of the film sample was measured. The results of measurement of Q and scratch-causing load are set forth in Table 3 below.

Compound A in the column "Sample No." in Table 3 has the following formula:

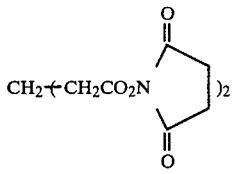

The compound A is described in Japanese Patent Application (OPI) No. 154350/75; it hardens gelatin very quickly, is substantially free from "after-hardening" but is insoluble in water and is difficult to apply in an even thickness.

TABLE 3

| Sample No. | Hardening Agent | Solubility in Water | Amount Added (meq./100 g dry gel) | Q 1 Day | Q 7 Days | Q 14 Days | Scratch Resistance (7 days storage) (g) |
|---|---|---|---|---|---|---|---|
| 1 | None | — | — | 10.1 | 10.0 | 10.2 | 7 |
| 2 | P-4 | soluble | 20 | 5.3 | 5.1 | 5.0 | 66 |
| 3 | P-6 | " | 20 | 4.0 | 3.8 | 3.8 | 104 |
| 4 | P-12 | " | 10 | 2.8 | 2.7 | 2.7 | 120 |
| 5 | Compound A | insoluble | 10 | 3.6 | 3.5 | 3.6 | 110 |

As is clear from Table 3, the polymers of this invention are water-soluble and are good hardening agents that harden gelatin very fast and are substantially free from after-hardening.

EXAMPLE 2

A high speed negative photographic emulsion containing 120 g of gelatin and 65 g of silver iodobromide per kilogram of emulsion was prepared in a conventional manner. Polymers P-4, P-6 and P-12 of this invention were added to the emulsion in the amounts indicated in Table 4 and applied uniformly to a subbed cellulose triacetate support in a dry thickness of 10μ. After drying, the samples formed were stored for 7 days at room temperature and the degree of swelling in water at 25° C. was measured in the same manner as in Example 1. The resulting film samples were exposed through a wedge, developed with D-76 developer at 20° C. for 8 minutes, fixed, washed with water, dried and subjected to sensitometry to determine their sensitivity and degree of fogging. Further, the samples formed were stored for 2 days at 50° C., exposed through a wedge, developed with D-76 developer at 20° C. for 8 minutes, fixed, washed with water, dried and subjected to sensitometry to determine their sensitivity and degree of fog.

As is clear from Table 4, the polymers of this invention provided a film strength sufficient for practical purposes and did not impair photographic characteristics.

TABLE 4

| Sample No. | Hardening Agent | Amount Added (meq./100 g dry gel) | Photographic Characteristics: 7 Days Storage at Room Temperature, Relative Sensitivity | 7 Days Storage at Room Temperature, Fogging | 2 Days Storage at 50° C., Relative Sensitivity | 2 Days Storage at 50° C., Fogging | Q | Film Strength 7 Days Storage at Room Temperature, Scratch Resistance (g) |
|---|---|---|---|---|---|---|---|---|
| 1 | None | — | 100 | 0.05 | 100 | 0.10 | 9.9 | 7 |
| 2 | P-4 | 20 | 91 | 0.05 | 90 | 0.06 | 5.0 | 61 |
| 3 | P-6 | 20 | 88 | 0.07 | 87 | 0.08 | 3.7 | 92 |
| 4 | P-12 | 10 | 88 | 0.06 | 87 | 0.07 | 2.7 | 113 |
| 5 | Compound A | 10 | 89 | 0.04 | 88 | 0.05 | 3.4 | 98 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one layer containing a polymer having a repeating unit of formula (I):

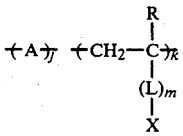

(I)

wherein A is a monomer unit copolymerized with a copolymerizable ethylenically unsaturated monomer; R is a hydrogen atom or a lower alkyl group having 1 to about 6 carbon atoms; L is a bivalent linking group having 1 to about 20 carbon atoms; X is an active ester group selected from the group consisting of

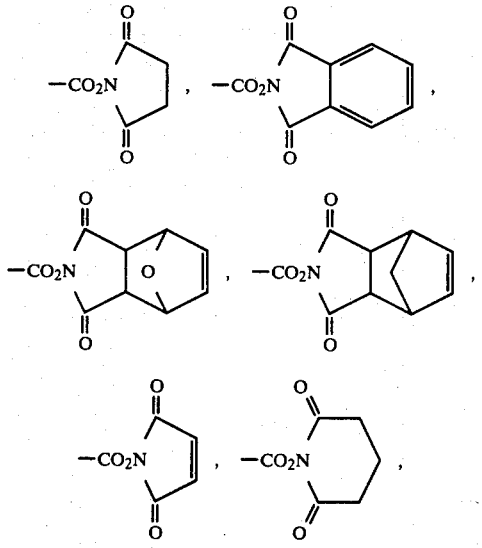

-continued

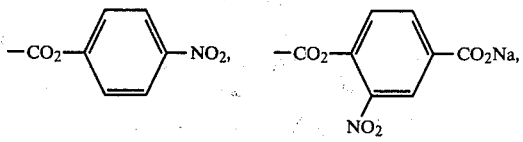

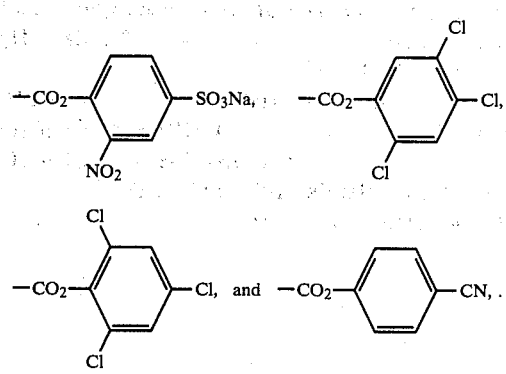

j and k each represents molar percent, and j being between 0 and 95 and k being between 5 and 100; m is 0 or 1.

2. The photographic material of claim 1, wherein A is ethylene, propylene, 1-butene, isobutene, styrene, chloromethylstyrene, hydroxymethylstyrene, sodium vinylbenzenesulfonate, sodium vinylbenzylsulfonate, N,N,N-trimethyl-N-vinylbenzylammonium chloride, N,N-dimethyl-N-benzyl-N-vinylbenzylammonium chloride, α-methylstyrene, vinyltoluene, 4-vinylpyridine, 2-vinylpyridine, benzyl vinylpyridinium chloride, N-vinylacetamide, N-vinylpyrrolidone, 1-vinyl-2-methylimidazole, monoethylenically unsaturated esters of aliphatic acids, ethylenically unsaturated mono- or dicarboxylic acids and salts thereof, maleic anhydride, esters of ethylenically unsaturated monocarboxylic or dicarboxylic acids, or amides of ethylenically unsaturated monocarboxylic or dicarboxylic acids.

3. The photographic material of claim 1, wherein R is a hydrogen atom, a methyl group, an ethyl group, a butyl group, or an n-hexyl group.

4. The photographic material of claim 1, wherein R is a hydrogen atom or a methyl group.

5. The photographic material of claim 1, wherein L is a group represented by the formula (II), formula (III) or formula (IV):

$$-Y- \quad \text{(II)}$$

$$-\underset{\underset{O}{\|}}{C}-Q-Z- \quad \text{(III)}$$

-continued (IV)

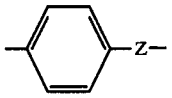

wherein Y is an alkylene group having 1 to 10 carbon atoms or an arylene group having 6 to 12 carbon atoms; Q is —O—, —NH— or $$-\overset{\overset{\displaystyle R}{|}}{N}-;$$

Z is a group represented by Y or a bivalent group having at least one amido, ester, ether or thioether bond and having Y at both ends; R is the same as defined in claim 1.

6. The photographic material of claim 1, wherein L is —$CONHCH_2$—, —$CONHCH_2CH_2$—, —$CONHCH_2CH_2CH_2$—, —$CONHCH_2CH_2CH_2CH_2CH_2$—, —$CO_2CH_2CH_2OCOCH_2CH_2$—, —$CONHCH_2CONHCH_2$—, —$CONHCH_2CONHCH_2CONHCH_2$—, —$CO_2CH_2$—, —$CONHCH_2NHCOCH_2CH_2SCH_2CH_2$—, or —$CONHCH_2OCOCH_2CH_2$—.

7. The photographic material of claim 1, wherein X is a carboxylic acid ester of an alcohol having a pKa of 5 to 13.

8. The photographic material of claim 1, wherein the polymer having the repeating unit of the formula (I) is an antistatic agent.

9. The photographic material of claim 8, wherein A is a cationic monomer or an anionic monomer.

10. The photographic material of claim 1, wherein the polymer having the repeating unit of the formula (I) is a mordant.

11. The photographic material of claim 10, wherein A is a cationic monomer.

12. The photographic material of claim 1, wherein the polymer having the repeating unit of the formula (I) is a hardening agent.

13. The photographic material of claim 12, wherein A is an ionic monomer or acrylamide.

14. The photographic material of claim 12, wherein the polymer is present in said layer in an amount of from $0.5\times10^{-3}$ to $5\times10^{-2}$ equivalent of active ester group per 100 g of dry gelatin in said layer.

15. The photographic material of claim 12, wherein the polymer is present in said layer in an amount of from $5\times10^{-3}$ to $5\times10^{-2}$ equivalent of active ester group per 100 g of dry gelatin in said layer.

16. The photographic material of claim 1, wherein the polymer having the repeating unit of the formula (I) is a crosslinked latex.

* * * * *